US012679513B2

(12) United States Patent
Niedostatek

(10) Patent No.: US 12,679,513 B2
(45) Date of Patent: Jul. 14, 2026

(54) FIN STABILIZER

(71) Applicant: SKF MARINE GMBH, Hamburg (DE)

(72) Inventor: Mark Niedostatek, Wenzendorf (DE)

(73) Assignee: SKF MARINE GMBH, Hamburg (DE)

( * ) Notice: Subject to any disclaimer, the term of this patent is extended or adjusted under 35 U.S.C. 154(b) by 517 days.

(21) Appl. No.: 18/012,448

(22) PCT Filed: Jul. 15, 2021

(86) PCT No.: PCT/EP2021/069811
§ 371 (c)(1),
(2) Date: Dec. 22, 2022

(87) PCT Pub. No.: WO2022/013380
PCT Pub. Date: Jan. 20, 2022

(65) Prior Publication Data

US 2023/0271681 A1 Aug. 31, 2023

(30) Foreign Application Priority Data

Jul. 17, 2020 (DE) ..... 10 2020 208 970.1

(51) Int. Cl.
*B63B 39/06* (2006.01)

(52) U.S. Cl.
CPC ..... *B63B 39/06* (2013.01); *B63B 2039/063* (2013.01); *B63B 2039/068* (2013.01)

(58) Field of Classification Search
CPC ... B63B 39/00; B63B 39/06; B63B 2039/063; B63B 2039/068; B63B 32/64
(Continued)

(56) References Cited

U.S. PATENT DOCUMENTS 2,550,752 A 5/1951 Foggo
3,727,572 A * 4/1973 Nelson ..... G05D 1/0875 244/177

(Continued)

FOREIGN PATENT DOCUMENTS

CH 688769 A5 3/1998
CN 104309778 A 1/2015

(Continued)

OTHER PUBLICATIONS

International Search Report and Written Opinion dispatched Jan. 20, 2022 for parent application No. PCT/EP2021/069811.

(Continued)

*Primary Examiner* — Daniel V Venne
(74) *Attorney, Agent, or Firm* — J-TEK LAW PLLC; Jeffrey D. Tekanic; Scott T. Wakeman

(57) ABSTRACT

A fin stabilizer is for the roll-stabilizing of a watercraft in motion, at anchor, or at zero speed, including a shaft on which a stabilizing fin is disposed. The shaft is drivable by a drive unit for changing at least one angle of attack of the stabilizing fin in the water. A cross-sectional geometry of the stabilizing fin is changeable by at least one actuator, and the stabilizing fin forms a closed surface geometry. Due to the hydraulically effective cross-sectional geometry of the stabilizing fin, which cross-sectional geometry is largely changeable by at least one actuator, a significantly increased energy efficiency of the fin stabilizer results with a simultaneously improved stabilizing effect of the fin stabilizer, in particular with respect to suppressing rolling movements of the watercraft.

13 Claims, 2 Drawing Sheets

(58) Field of Classification Search
USPC ..... 114/122, 126, 127, 144, 152, 162
See application file for complete search history.

(56) References Cited

U.S. PATENT DOCUMENTS

| | | | | |
|---|---|---|---|---|
| 7,143,710 | B2 * | 12/2006 | Lang | B63B 39/06 114/61.12 |
| 10,040,520 | B2 * | 8/2018 | Venables | B63B 39/06 |
| 10,351,217 | B2 * | 7/2019 | Crupi | B63B 39/062 |
| 12,240,583 | B2 * | 3/2025 | Venables | B63H 25/44 |
| 2016/0059941 | A1 | 3/2016 | Buechler et al. | |
| 2019/0202535 | A1 | 7/2019 | Skauen et al. | |

FOREIGN PATENT DOCUMENTS

| | | | |
|---|---|---|---|
| DE | 4334496 | A1 | 4/1995 |
| DE | 202013000790 | U1 | 2/2013 |
| KR | 20150054365 | A | 5/2015 |
| KR | 101827164 | B1 | 2/2018 |

OTHER PUBLICATIONS

Office Action and Search Report from the Chinese Patent Office dispatched Apr. 14, 2025 in related application No. CN 202180040938.4, and translation thereof.

* cited by examiner

FIN STABILIZER

CROSS-REFERENCE

This application is the U.S. National Stage of International Application No. PCT/EP2021/069811 filed on Jul. 15, 2021, which claims priority to German patent application no. 10 2020 208 970.1 filed on Jul. 17, 2020.

BACKGROUND OF THE INVENTION

The invention relates to a fin stabilizer for the roll-stabilizing of a watercraft in motion, at anchor, or at zero speed, including a shaft on which a stabilizing fin is disposed, wherein the shaft is drivable by a drive unit for changing at least one angle of attack of the stabilizing fin in the water.

Fin stabilizers including a one-part stabilizing fin generally have quite good flow properties, wherein due to the unchangeability of the cross-sectional profile of the stabilizing fin, the effectiveness of the stabilizing effect cannot optimally meet all operating conditions. In addition, fin stabilizers are known including a multipart stabilizing fin whose cross-sectional profile is variable by different angle of attack of at least one flap, of one attachment part, or the like. With such stabilizing fins a better stabilizing effect is achievable in comparison to those having an unchangeable cross-sectional profile. However, gaps and points of discontinuity between the movable attachments and the immovable regions of variable-cross-section stabilizing fins are disadvantageous, which leads to turbulence and thus concomitantly to an increase of the hydromechanical resistance in the water. Thus in general a significantly increased energy requirement of a fin stabilizer equipped with a multipart stabilizing fin is also involved.

SUMMARY OF THE INVENTION

An object of the invention is therefore to specify a fin stabilizer having an improved energy efficiency with a simultaneously increased stabilizing effect.

The above-mentioned object is achieved by a cross-sectional geometry of the stabilizing fin being changeable by at least one actuator, and the stabilizing fin forms a closed surface geometry. The inventive fin stabilizer thereby combines the advantages of a one-part stabilizing fin including an unchangeable cross-sectional geometry with those of a multi-part stabilizing fin including at least one adjustable fin section or an attachment part. Due to the completely self-contained surface of the stabilizing fin—which remains free of points of discontinuity—practically no turbulence occurs with changing of the cross-sectional geometry, which turbulence would otherwise lead to a reduction of the lifting force, an increase of the flow resistance, and to an increase of the energy requirement of the fin stabilizer. Consequently a reduction of the energy requirement of the fin stabilizer is realizable with a simultaneous improvement of the stabilizing effect of the fin stabilizer.

The stabilizing fin preferably includes an inflow body, and an outflow body arranged at a distance therefrom, wherein the inflow body and the outflow body are fixedly connected to each other by a connecting body disposed therebetween. Despite its variable cross-sectional geometry, the stabilizing fin thereby represents a one-piece, but sectionally flexible unit.

In one technically advantageous design, the connecting body is formed by at least one elastic deforming body. The changing of the cross-sectional geometry of the stabilizing fin is thereby largely realizable without a disadvantageous influencing of the surface geometry, in particular due to the arising of points of discontinuity such as steps, shoulders, or recesses The connecting body preferably includes at least one support element whose bending stiffness is significantly higher than that of the at least one elastic deforming body of the connecting body. A sufficient resistance of the connecting body with respect to the inflowing water, and thus a defined geometric deformability of the stabilizing fin, is thereby available.

In the case of one further advantageous design, a central plane of the inflow body, a central plane of the outflow body, and a central plane of the connecting body extend essentially in one base plane. Consequently the cross-sectional geometry of the stabilizing fin in the undeformed base state of the connecting body corresponds essentially to that of a conventional, one-part stabilizing fin whose cross-sectional geometry in turn corresponds approximately to that of an airfoil of an aircraft.

In the case of one favorable refinement, the inflow body and the outflow body are connected to each other by the connecting body such that in a deformation state of the connecting body, there is an outflow angle between the central plane of the outflow body and the central plane of the inflow body. The desired lifting force increasing or downforce increasing effect of the stabilizing fin acted upon by water is thereby achieved during operation of the fin stabilizer.

The at least one actuator is preferably integrated into the inflow body. A controlled and remotely controllable change of the cross-sectional geometry of the stabilizing fin is thereby realizable. In addition, the largest installation space volume for the at least one actuator is available in the outflow body.

In one refinement the at least one actuator is connected to the outflow body by at least one coupling link.

Consequently an integration of the at least one actuator into the inflow body of the stabilizing fin is possible.

A first end of the coupling link is preferably connected to the at least one actuator, and a second end of the coupling link is connected to the outflow body outside the central plane of the outflow body. Due to this eccentric coupling of the actuator, at least one pivoting out of the central plane of the outflow body from the central plane of the inflow body or of the base plane is possible. For this purpose the first end of the coupling link is hinged, for example, on a pivotable lever arm of the at least one actuator.

In the case of one technically advantageous design, using the at least one actuator at least one outflow angle between the central plane of the outflow body is changeable with respect to the central plane of the inflow body. A precise and remotely controllable setting of the outflow angle of the outflow body of the stabilizing fin is thereby possible even with high hydrodynamic forces acting on the stabilizing fin due to the inflowing water.

In one technical refinement it is provided that the at least one actuator is controllable by a control and/or regulating unit such that an increase of the energy efficiency and/or of the stabilizing effect of the fin stabilizer results. This enables the pivotable outflow body to be incorporated into a stabilization algorithm implemented by the control and/or regulating unit. Here the stabilizing effect is achieved by a suitable combination of pivot movements of the stabilizing fin about the fin carrying shaft, and/or a variation of the cross-sectional geometry of the outflow body, each controlled by the control and/or regulating unit.

BRIEF DESCRIPTION OF THE SEVERAL VIEWS OF THE DRAWINGS

In the following a preferred exemplary embodiment of the invention is explained in more detail with reference to schematic Figures.

DETAILED DESCRIPTION OF THE INVENTION

Figure 1:
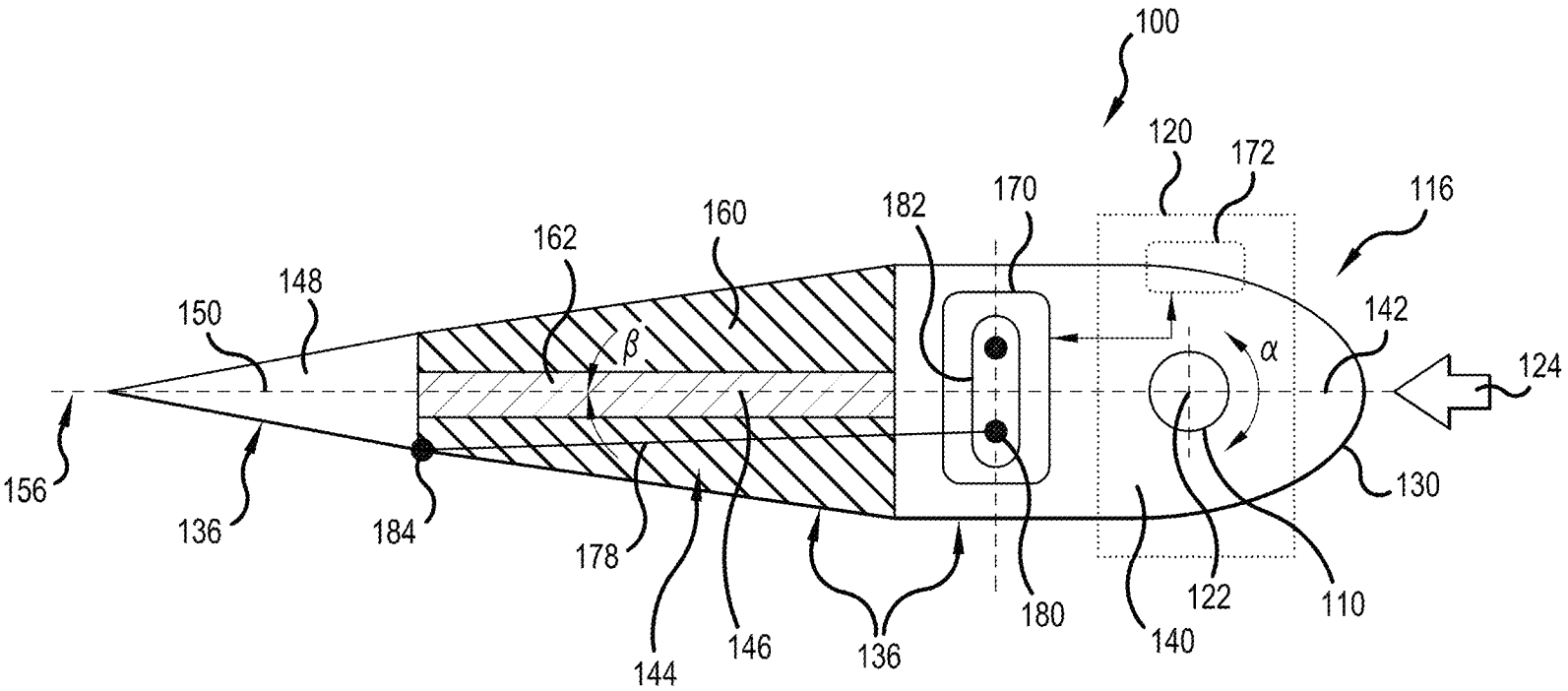
FIG. 1 shows a schematic depiction of the fin stabilizer, including a stabilizing fin in an undeformed base state of the stabilizing fin.

FIG. 1 shows a schematic depiction of the fin stabilizer, including a stabilizing fin in an undeformed base state of the stabilizing fin. A fin stabilizer 100 for preferred roll stabilizing of a not-depicted watercraft, such as a ship or pontoon, comprises inter alia a fin carrying shaft 110 on which a stabilizing fin 116 is attached. Using a drive unit 120 graphically indicated only by a dotted line, the shaft 110 is rotatable about a longitudinal central axis 122 by an angle of attack α. The angle of attack α can fall, for example, in a range of ±45°. The stabilizing fin 116 is located completely in the water that acts upon the stabilizing fin 116 in a preferred flow direction 124.

Using an actuator, a cross-sectional geometry 130 of the stabilizing fin 116 is changeable largely steplessly, wherein independent of the configured change the cross-sectional geometry 130 of the stabilizing fin 116 always forms a closed surface geometry 136, i.e., a self-contained peripheral contour. In the context of the present description, the term "self-contained surface geometry" defines a surface that is free of points of discontinuity, such as steps, shoulders, recesses, grooves, notches, channels, gaps, holes, bores, etc.

Here by way of example the stabilizing fin 116 includes an inflow body 140 and an outflow body 148 arranged at a distance therefrom, which inflow body 140 and outflow body 148 are connected to each other by a connecting body 144 disposed therebetween. Here the inflow body 140 includes a cross-sectional geometry symmetric with respect to an associated central plane 142, which cross-sectional geometry essentially corresponds to that of a rectangle, wherein a semioval directed against the flow direction 124 is upstream of the rectangle. In the undeformed base state, by way of example the connecting body 144 has a cross-sectional geometry that corresponds to a trapezoid symmetric with respect to an associated central plane 146, and a cross-sectional shape of the outflow body 148 essentially follows the shape of an isosceles triangle that is also configured symmetrically with respect to an associated central plane 150. As a result, the cross-sectional geometry 130 of the stabilizing fin 116 has an almost optimal hydrodynamic design for the inflowing water.

In the undeformed base state, shown here by way of example, of the stabilizing fin 116, the central planes 142, 146, and 150 lie in a common base plane 156. The water preferably flowing from the flow direction 124 first impacts against the inflow body 140, passes the connecting body 144, and finally flows off over the outflow body 148 of the stabilizing fin 116.

The connecting body 144 is formed by at least one elastic deformation body 160 into which at least one support element 162 is integrated whose bending stiffness is preferably significantly higher than that of the deformation body 160. For example, the deformation body 160 can be formed by an elastomer, such as, for example, silicone, rubber, or the like. Because the connecting body 144 is formed from a deformation body 160 that in turn may be formed from an elastomer, the connecting body 144 may sometimes be referred to herein as an "elastomeric connecting body" 144. The support element 162 can be realized, for example, by a fiber composite plastic, a resilient metal, etc. The changing of the cross-sectional geometry 130 of the stabilizing fin 116 is effected solely by a corresponding elastic deformation of the connecting body 144.

Since the inflow body 140 generally has the largest usable installation space, at least one actuator 170 is preferably integrated into the inflow body 140. The at least one actuator 170 is controllable by a control and/or regulating unit 172. The control and/or regulating unit 172 preferably simultaneously serves for controlling, by the drive unit 120, an angle of attack α of the stabilizing fin 116 with respect to the surrounding water. Here the actuator 170 is flexibly connected to the outflow body 148 by a coupling link 178 configured in the manner of a thrust rod. A first end 180 of the coupling link 178 is linked to a rotatable pivot arm 182 of the actuator 170, while a second end 184 of the coupling link 178 is flexibly connected to the outflow body 150 outside the central plane 150 of the outflow body 148. Instead of the eccentric drive, shown here merely by way of example, for the mechanical coupling of actuator 170 and outflow body 148, using a not-indicated linear actuator or using an alternative transmission design, the outflow body 148 can be, for example, directly coupled using the at least one actuator 170. Furthermore, a deformation of the deformation body 160 and of the support element 162 of the connecting body 144 is possible using an actuator, for example, integrated therein.

In the undeformed base state shown here of the stabilizing fin 116, an outflow angle β between the central plane 142 of the inflow body 140 and the central plane 150 of the outflow body 148 is 0°, since in the undeformed base state both central planes 142, 150 lie in the base plane 156 of the stabilizing fin 160. The same applies to the central plane 146 of the deformation body 144.

Figure 2:
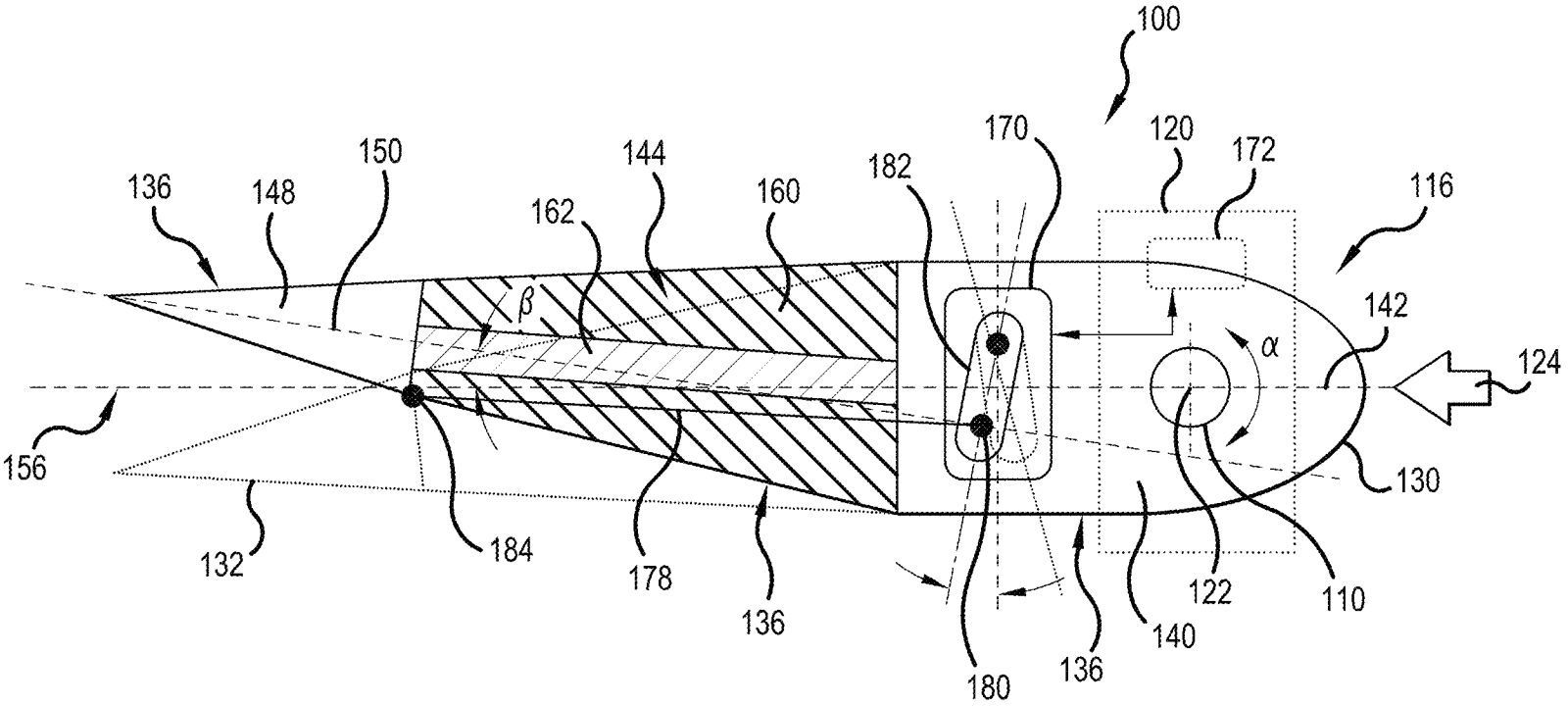
FIG. 2 shows the stabilizing fin of the fin stabilizer of FIG. 1 in a deformation state.

The inflow body 140 and the outflow body 148 are elastically connected to each other by the connecting body 144 such that in a deformation state, depicted in FIG. 2, of the stabilizing fin 116, due to an elastic deformation of the deformation body 160 and of the support element 162 of the connecting body 144, with the operation of the actuator 170 there is at least one outflow angle β different from 0° between the central plane 142 of the inflow body 140 and the central plane 150 of the outflow body 148.

Using the control and/or regulating unit 172, the at least one actuator 170 is controllable here such that due to the changing of the cross-sectional geometry 130 of the stabilizing fin 116, an increase of the energy efficiency results and/or an increase of the stabilizing effect of the fin stabilizer 100 results with energy consumption remaining constant.

FIG. 2 illustrates the stabilizing fin of the fin stabilizer of FIG. 1 in a deformation state. The fin stabilizer 100 in turn comprises the fin carrying shaft 110 including the stabilizing fin 116 attached thereto, wherein the shaft 110 is drivable in a pivoting manner about the longitudinal central axis 122 by the drive unit 120 under the control of the control and/or regulating unit 172. The stabilizing fin 116 acted upon by water in the preferred flow direction 124 is in turn divided into the inflow body 140, the elastic connecting body 144 including the elastic deformation body 160 having the support element 162 integrated therein, and the outflow body 148, wherein the inflow body 140, the connecting body 144, and the outflow body 148 are connected to each other to provide a compact unit. Using the coupling link 178, the pivot arm 182 of the actuator 170 controlled by the control and/or regulating unit 172 is hinged to the outflow body 148 of the stabilizing fin 116. In comparison to the depiction of FIG. 1, the inflow body 140 is located unchanged in a symmetric position with respect to the base plane 156.

Due to the operating of the actuator, which operating is controlled by the control and/or regulating unit 172, the pivot arm 182 of the actuator 170 is rotated from the rest position of FIG. 1 by the pivot angle γ, whereby the outflow angle β between the central plane 150 of the outflow body 148 and the base plane 156 is increased to a value different from zero, and the deformation state of the stabilizing fin 116 is achieved. In the course of this deformation the support element 162 is bent upward in the manner of a cantilever, and the elastic deformation body 160 of the connecting body 144 is deformed approximately into a general quadrilateral. During this process the cross-sectional geometry 130 or the peripheral contour of the stabilizing fin 116 changes such that the stabilizing fin 116 has, in comparison to the base state of FIG. 1, altered hydrodynamic properties, and the stabilizing fin 116 is optimally adaptable to changed operating conditions of the fin stabilizer 100. However, due to the elastically formed connecting body 144, the surface geometry 136 or the upper or enveloping surface of the stabilizing fin 116 remains free of any points of discontinuity that would lead to eddies, and thus concomitantly to a non-laminar flow around the stabilizing fin 116, and thus as a result to an increase of the hydraulic flow resistance of the stabilizing fin 116.

However, if the pivot arm 182 of the actuator 170 is rotated by the same pivot angle γ in the opposite direction, then a complementary cross-sectional geometry 132 of the stabilizing fin 116 indicated by dotted lines results. Here the two cross-sectional geometries 130, 132 are mirror-symmetric with respect to the base plane 156 of the stabilizing fin 116.

Between the base state of the stabilizing fin 116, illustrated in FIG. 1, and the deformation state of the stabilizing fin 116, depicted in FIG. 2, a plurality of (intermediate) deformation states are represented by correspondingly less rotating of the pivot arm 182 of the actuator 170 under the control of the control and/or regulating unit 172.

Since the cross-sectional geometry 130, 132 of the stabilizing fin 116 can be adapted to the respective current operating conditions in the water, optimally and nearly in real time, a considerable increase of the energy efficiency of the fin stabilizer 100 is realizable with a simultaneous optimization of the stabilizing effect of the fin stabilizer 100.

The invention relates to a fin stabilizer 100 for the roll-stabilizing of a watercraft in motion, at anchor, or at zero speed, including a shaft 110 on which a stabilizing fin 116 is disposed, wherein the shaft 110 is drivable by a drive unit 120 for changing at least one angle of attack α of the stabilizing fin 116 in the water. According to the invention it is provided that a cross-sectional geometry 130 of the stabilizing fin 116 is changeable by at least one actuator 170, and the stabilizing fin 116 forms a closed surface geometry 136. Due to the hydraulically effective cross-sectional geometry 130 of the stabilizing fin 116, which cross-sectional geometry 130 is largely changeable by at least one actuator 170, a significantly increased energy efficiency of the fin stabilizer 100 results with a simultaneously improved stabilizing effect of the fin stabilizer 100, in particular with respect to suppressing rolling movements of the watercraft.

REFERENCE NUMBER LIST

100 Fin stabilizer
110 Fin carrying shaft
116 Stabilizing fin
120 Drive unit
122 Longitudinal central axis (fin carrying shaft)
124 Flow direction (water)
130 Cross-sectional geometry (stabilizing fin)
132 Complementary cross-sectional geometry (stabilizing fin)
136 Surface geometry (stabilizing fin)
140 Inflow body
142 Central plane
144 Connecting body
146 Central plane
148 Outflow body
150 Central plane
156 Base plane (undeformed base state)
160 Elastic deformation body
162 Support element
170 Actuator
172 Control and/or regulating unit
178 Coupling link (coupling rod)
180 First end (coupling link)
182 Pivot arm (actuator)
184 Second end (coupling link)
α Angle of attack (fin carrying shaft)
β Outflow angle (outflow body, base plane)
γ Pivot angle (pivot arm actuator)

The invention claimed is:

1. A fin stabilizer for roll-stabilizing a watercraft in motion, at anchor, or at zero speed, the fin stabilizer comprising:
- a shaft,
- a stabilizing fin disposed on the shaft and forming a self-contained surface geometry,
- a drive unit for driving the shaft and for changing at least one angle of attack of the stabilizing fin in water, and
- at least one actuator configured to change a cross-sectional geometry of the stabilizing fin,
- wherein the stabilizing fin comprises an inflow body spaced from an outflow body by an elastomeric connecting body, the elastomeric connecting body connecting the inflow body to the outflow body, and
- wherein the change of the cross-sectional geometry of the stabilizing fin is effected solely by an elastic deformation of the elastomeric connecting body.

2. The fin stabilizer according to claim 1, wherein in an undeformed base state of the elastomeric connecting body, a central plane of the inflow body, a central plane of the outflow body, and a central plane of the elastomeric connecting body extend substantially in one base plane.

3. The fin stabilizer according to claim 2, wherein the inflow body and the outflow body are connected to each other by the elastomeric connecting body such that in a deformation state of the elastomeric connecting body, an outflow angle is defined between the central plane of the outflow body and the central plane of the inflow body.

4. The fin stabilizer according to claim 1, wherein the at least one actuator is integrated into the inflow body.

5. The fin stabilizer according to claim 4, wherein the at least one actuator is connected to the outflow body by at least one coupling link.

6. The fin stabilizer according to claim 5, wherein a first end of the coupling link is connected to the at least one actuator and a second end of the coupling link is connected to the outflow body outside the central plane of the outflow body.

7. The fin stabilizer according to claim 1, wherein the at least one actuator is configured to change at least one outflow angle between a central plane of the outflow body and a central plane of the inflow body.

8. The fin stabilizer according to claim 1, wherein the at least one actuator is controllable by a control and/or regulating unit to increase an energy efficiency and/or to increase a stabilizing effect of the fin stabilizer.

9. The fin stabilizer according to claim 1, wherein the self-contained surface geometry comprises a surface free from steps, shoulders, recesses, grooves, notches, channels, gaps, holes or bores.

10. A fin stabilizer for roll-stabilizing a watercraft in motion, at anchor, or at zero speed, the fin stabilizer comprising:

a shaft, a stabilizing fin disposed on the shaft and forming a self-contained surface geometry, a drive unit for driving the shaft and for changing at least one angle of attack of the stabilizing fin in water, and at least one actuator configured to change a cross-sectional geometry of the stabilizing fin, wherein the stabilizing fin comprises an inflow body spaced from an outflow body by an elastomeric connecting body, the elastomeric connecting body connecting the inflow body to the outflow body, and wherein an outermost surface of the inflow body forms a first portion of the self-contained surface geometry and an outermost surface of the elastomeric connecting body forms a second portion of the self-contained surface geometry and an outermost surface of the outflow body forms a third portion of the self-contained surface geometry.

11. The fin stabilizer according to claim 10, wherein the outermost surface of the elastomeric connecting body does not overlap and is not overlapped by the outermost surface of the inflow body, and wherein the outermost surface of the elastomeric connecting body does not overlap and is not overlapped by the outermost surface of the outflow body.

12. The fin stabilizer according to claim 10, wherein the change of the cross-sectional geometry of the stabilizing fin is effected solely by an elastic deformation of the elastomeric connecting body.

13. The fin stabilizer according to claim 1, wherein an outermost surface of the inflow body forms a first portion of the self-contained surface geometry and an outermost surface of the elastomeric connecting body forms a second portion of the self-contained surface geometry and an outermost surface of the outflow body forms a third portion of the self-contained surface geometry.

* * * * *